US006719264B2

(12) United States Patent
Mattes

(10) Patent No.: US 6,719,264 B2
(45) Date of Patent: Apr. 13, 2004

(54) VALVE FOR CONTROLLING FLUIDS

(75) Inventor: Patrick Mattes, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/018,524

(22) PCT Filed: Mar. 20, 2001

(86) PCT No.: PCT/DE01/01055

§ 371 (c)(1),
(2), (4) Date: Mar. 12, 2002

(87) PCT Pub. No.: WO01/81754

PCT Pub. Date: Nov. 1, 2001

(65) Prior Publication Data

US 2002/0104976 A1 Aug. 8, 2002

(30) Foreign Application Priority Data

Apr. 20, 2000 (DE) ..... 100 19 765

(51) Int. Cl.[7] ..... F02M 37/04
(52) U.S. Cl. ..... 251/57; 239/102.2
(58) Field of Search ..... 251/57, 129.06; 239/102.2

(56) References Cited

U.S. PATENT DOCUMENTS 3,648,967 A * 3/1972 O'Neil et al. ..... 251/57
4,762,300 A * 8/1988 Inagaki et al. ..... 251/129.06
5,779,149 A * 7/1998 Hayes, Jr. ..... 239/124
6,062,532 A * 5/2000 Gurich et al. ..... 251/57
6,155,532 A * 12/2000 Heinz et al. ..... 251/57
6,427,664 B1 * 8/2002 Boecking ..... 123/446
6,530,555 B1 * 3/2003 Stoecklein et al. ..... 251/57
6,547,213 B1 * 4/2003 Heinz et al. ..... 251/57

FOREIGN PATENT DOCUMENTS

| | | |
|---|---|---|
| DE | 198 07 903 A | 9/1999 |
| EP | 0 477 400 A | 4/1992 |
| EP | 0 816 670 A | 1/1998 |

* cited by examiner

*Primary Examiner*—Gene Mancene
*Assistant Examiner*—Eric Keasel

(57) ABSTRACT

The invention relates to a valve for controlling fluids, having an actuator unit for actuating a valve member which has a first piston and a second piston, separated from it by a hydraulic chamber, and which actuates a valve closing member that divides a low-pressure region at system pressure from a high-pressure region. For leakage compensation, a filling device connectable to the high-pressure region is provided with a hollow chamber, in which a throttle body is disposed such that a line leading to the high-pressure region discharges into the hollow chamber on one end of the throttle body, and on the other end a system pressure line leading to the hydraulic booster branches off. The system pressure is built up as a function of the prevailing pressure in the high-pressure region, by means of geometrically defining the throttle body, a gap surrounding it, and the dimensions of the piston along which the system pressure is reduced.

20 Claims, 2 Drawing Sheets

VALVE FOR CONTROLLING FLUIDS

CROSS-REFERENCE TO RELATED APPLICATIONS

This application is a 35 USC 371 application of PCT/DE 01/01055 filed on Mar. 20, 2001.

BACKGROUND OF THE INVENTION

1. Field of the Invention

The invention is directed to valves for controlling fluids in systems such as fuel injection systems for internal, combustion engines.

2. Description of the Prior Art

One such valve is described in European Patent Disclosure EP 0 477 400 A1, for instance, in which the deflection of a piezoelectric actuator is transmitted via a hydraulic chamber that functions as a hydraulic booster or tolerance compensation element and encloses a common compensation volume between two pistons defining this chamber, one of which is embodied with a smaller diameter and connected to a triggering valve closing member, and the other of which is embodied with a larger diameter and is connected to the piezoelectric actuator. Thus the actuating piston executes a stroke that is lengthened by the boosting ratio of the piston diameter, when the larger piston is moved a certain distance by the piezoelectric actuator.

This known valve is intended to separate a low-pressure region from a high-pressure region and can for instance be used in fuel injectors, in particular common rail injectors, or pumps of motor vehicles, where such valves are also known in various versions in the industry.

If such a valve is to be functional, the hydraulic system requires a system pressure in the low-pressure region, especially in the hydraulic coupler, but this system pressure drops as a function of leakage unless adequate replenishment with hydraulic fluid takes place. As a rule, a filling device is therefore provided, with which pressure medium from the high-pressure region can be resupplied to the system pressure region.

For common rail injectors, solutions to this problem are known in the industry, in which the system pressure, which is expediently generated in the valve itself and should also be as constant as possible upon system starting, is assured by delivering hydraulic fluid from the high-pressure region of the fuel to be controlled to the low-pressure region, where system pressure prevails, with the aid of leakage gaps, represented for example by leakage or filling pins. Typically, the system pressure is adjusted by a valve and can for instance also be kept constant by plurality of common rail valves.

A system pressure in the hydraulic chamber that is essentially constant and is at least largely independent of the prevailing high pressure in the high-pressure region presents the problem, however, that at high pressure values, great actuator force is required to open the valve closing member counter to the high-pressure direction, which this dictates a correspondingly large, cost-intensive dimensioning of the actuator unit. Furthermore, at high pressure in the high-pressure region, the positive displacement of hydraulic volume out of the hydraulic chamber via the gaps surrounding the adjacent pistons is reinforced accordingly, meaning that under some circumstances, the refilling time for building up and maintaining the counterpressure on the low-pressure region is prolonged, so that for lack of complete refilling, in the event of a re-actuation of the valve soon thereafter, a shorter valve stroke will be executed, which can adversely affect the opening behavior of the entire valve.

SUMMARY OF THE INVENTION

The valve of the invention for controlling fluids has the advantage that the system pressure is variable in a structurally simple way as a function of the pressure prevailing in the high-pressure region. Because of the high-pressure-dependent refilling, at a high pressure level in the high-pressure region an increase in the system pressure in the hydraulic chamber is possible, as a result of which the actuating piston is reinforced for opening the valve closing member counter to the existing high pressure. Advantageously, a reduced trigger voltage of the actuator unit is thus required, compared to a valve with a constant system pressure, and the valve of the invention can therefore be equipped with a smaller, less expensive actuator unit. The valve of the invention also makes a defined filling of the low-pressure region, especially the hydraulic chamber, possible. When the pressure in the high-pressure region is increasing, with the variable system pressure the refilling time can be shortened.

Structurally, the embodiment according to the invention is distinguished by its simplicity, which makes it possible to define the variable system pressure in the hydraulic chamber by means of easily adjustable geometric variables such as the diameters and lengths of the throttle body and of the piston, along which the system pressure is reduced toward the low-pressure region. Along with the low costs for production and assembly, above all the resistance of the system pressure supply to particles or dirt in the hydraulic fluid is advantageous; this can be ascribed to designing the refilling device with a quasi-secondary flow. The secure furnishing of the requisite system pressure over the entire engine performance graph is thereby assured.

In an especially advantageous version, it can be provided that the at least one throttle body is axially adjustably disposed in the hollow chamber and is preferably movable such that it at least partly intersects the branching point of the system pressure line when the system pressure drops. Thus the length of the gap around the throttle body through which a flow is required is shortened, resulting in a higher flow rate and an increase in the system pressure.

The valve according to the invention is especially well suited to triggering fuel injection valves, but in principle it can also be realized in all hydraulically boosted systems with a piezoelectric actuator or with a magnetic final control element, such as in pumps.

Further advantages and advantageous features of the subject of the invention can be learned from the description, drawing and claims.

BRIEF DESCRIPTION OF THE DRAWINGS

Two exemplary embodiments of the valve of the invention for controlling fluids are shown in the drawing and will be explained in further detail in the ensuing description. Shown are FIG. 1, a schematic, fragmentary view of a first exemplary embodiment of the invention for a fuel injection valve for internal combustion engines, in longitudinal section.

DESCRIPTION OF THE PREFERRED EMBODIMENTS

Figure 1:
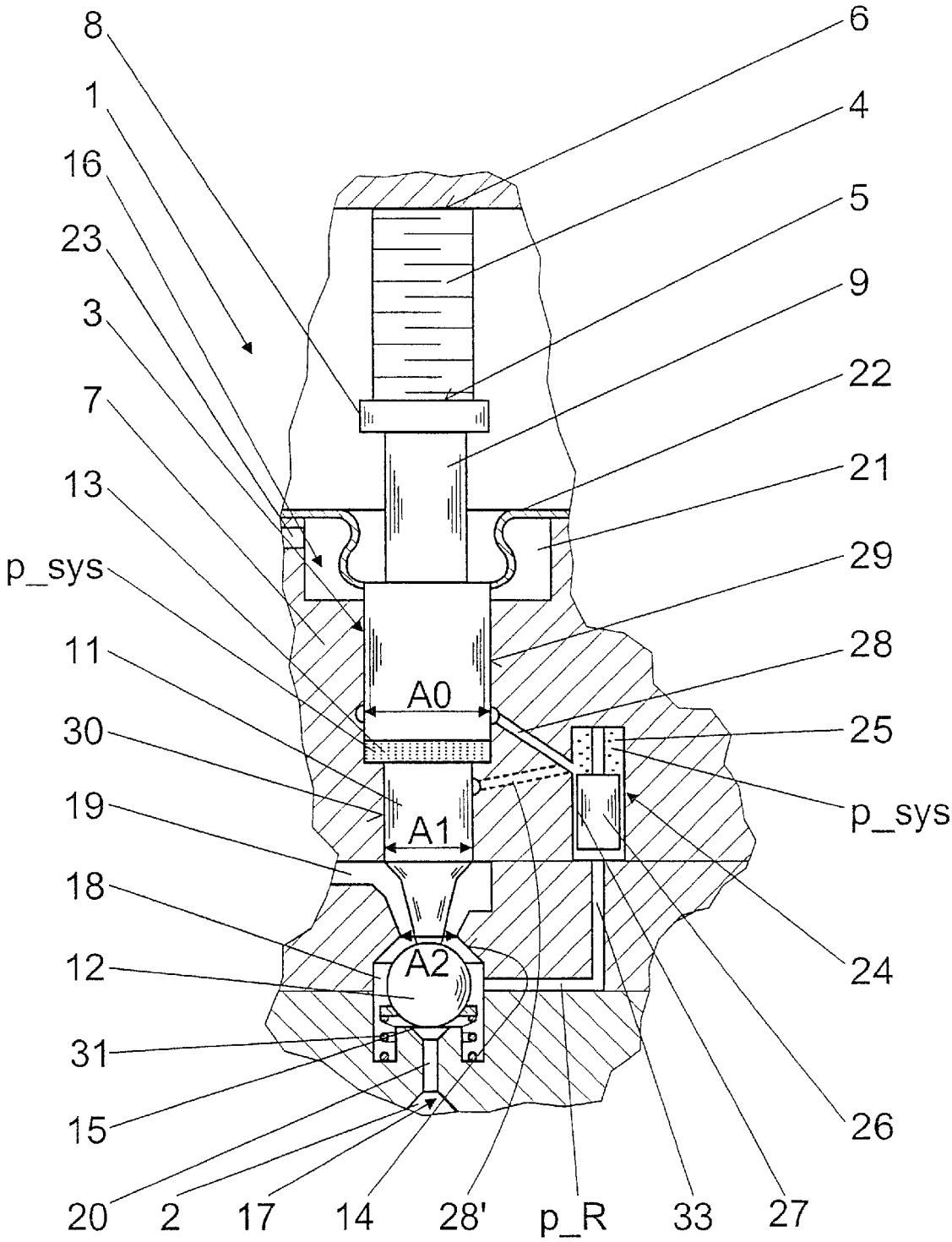

The exemplary embodiment shown in FIG. 1 illustrates a realization of a valve according to the invention in a fuel injection valve 1 for internal combustion engines of motor vehicles. This fuel injection valve 1 here is embodied as a common rail injector for injecting preferably Diesel fuel; the fuel injection is controlled via the pressure level in a valve control chamber 2 that communicates with a high-pressure supply.

Via force ratios in the fuel injection valve 1, an injection onset, injection duration and injection quantity are set. To that end, a valve member 3 is triggered via an actuator unit embodied as a piezoelectric actuator 4, which is disposed on the side of the valve member 3 remote from the valve control chamber 2 and is constructed of multiple layers in a manner known per se. On its side toward the valve member 3, the piezoelectric actuator 4 has an actuator head 5, and on its side remote from the valve member 3, it has an actuator foot 6, which is braced against a wall of a valve body 7. Resting on the actuator head 5 via a support 8 is a first piston 9 of the valve member 3, which can also be called a control piston. The valve member 3 includes, besides this first piston 9, a second piston 11, likewise disposed displaceably in a longitudinal bore of the valve body 7, that actuates a valve closing member 12 and is therefore also called an actuating piston.

The two pistons 9 and 11 define a hydraulic chamber, which serves as a hydraulic coupler and transmits the deflection of the piezoelectric actuator 4. Since the diameter A1 of the second piston 11 is less than the diameter A0 of the first piston 9, the second piston 11 executes a stroke that is lengthened by the boosting ratio of the piston diameter when the larger first piston 9 is moved a certain distance by the piezoelectric actuator 4.

Along with its function as a hydraulic coupler, the hydraulic chamber 13 also serves to compensate for tolerances resulting from temperature gradients in the component or different coefficients of temperature expansion of the materials used as well as possible settling effects, so that these factors continue to have no effect on the position of the valve closing member 12 to be triggered.

On the end toward the valve control chamber 2 of the valve member 3, the ball-like valve closing member 12 cooperates with valve seats 14, 15 embodied on the valve body 7 and in the process separates a low-pressure region 16 at the system pressure p_sys from a high-pressure region 17 at a high pressure or rail pressure p_R. The valve seats 14, 15 are embodied in a valve chamber 18 formed by the valve body 7, from which a leakage outlet conduit 19 leads away on the side of the valve seat 14 toward the piezoelectric actuator 4. On the high-pressure side, the valve chamber 18 can be made to communicate with the valve control chamber 2 of the high-pressure region 17, via the second valve seat 15 and an outlet throttle 20. In this valve control chamber 2, not shown in detail, a movable valve control piston can be disposed in a manner known per se, by whose axial motions in the valve control chamber 2, which in the usual way communicates with an injection line that in turn communicates with a high-pressure reservoir (common rail) that is common to a plurality of fuel injection valves and that supplies an injection nozzle with fuel, the injection behavior of the fuel injection valve 1 is controlled.

The end of the housing bore toward the piezoelectric actuator and having the valve member 3 is adjoined by a further valve pressure chamber 21, which is defined by the valve body 7, the first piston 9, and a sealing element 22 that is connected to both the first piston 9 and the valve body 7. A leakage line 23 leads out of this valve pressure chamber 21. In the version shown, the sealing element 22 is embodied as a bellowslike diaphragm and prevents the actuator 4 from coming into contact with the fuel contained in the low-pressure region 16.

To compensate for leakage losses on the low-pressure region 16 upon an actuation of the fuel injection valve 1, a filling device 24 is provided. It has a conduit-like hollow chamber 25, in which a pinlike throttle body 26 is disposed, with a gap 27 surrounding it. Discharging into a region of the hollow chamber 25 on one end of the throttle body 26 is a line 33, originating at the high-pressure region 17, and a system pressure line 28 that leads to the hydraulic chamber 13 branches off from a region of the hollow chamber 25 on the opposite end of the throttle body 26. The system pressure line 28, in the preferred embodiment shown, discharges into a gap 29 which surrounds the first piston 9 and by way of which the system pressure is reduced toward the valve pressure chamber 21 and thus toward the low-pressure region 16.

It is understood that in a version that deviates from this it may also be provided that the system pressure line 28 discharges into a gap 30 surrounding the second piston 11, as indicated in FIG. 1 with the line 28' drawn in dashed lines, or that the system pressure line discharges directly into the hydraulic chamber 13. The indirect filling of the hydraulic chamber 13, however, serves to improve the pressure holding capacity in the hydraulic chamber during the triggering.

The arrangement shown in FIG. 1 thus represents an in-line connection of two separate pistons, namely the throttle body 26 and the first piston 9, by way of which the high pressure p_R is reduced toward the low-pressure region 16. The high pressure p_R is reduced to the system pressure p_sys across the gap 27 of the throttle body 26, which is disposed essentially axially immovably in the hollow chamber 25. The pressure divider ratio is adjusted by means of the ratio of the lengths and diameters of the throttle body 26 and the downstream piston 9. Adjusting the system pressure p_sys by means of the separate pistonlike components makes it possible to make the length of the throttle body very slight, since the second half of the pressure divider is formed by the piston 9. The short lengths or greater diameters make a higher quality of the components possible, while simultaneously reducing costs for production and above all for the adjustment or assembly.

The system pressure p_sys, which is reached after an injection after a certain refilling time, and the ratio of the diameters and leakage gap lengths at the throttle body 26 and the piston 9 are dependent on a plurality of parameters, among which are the seat diameter A2 of the first valve seat 14 and the ratio of the diameter A0 of the first piston 9 to the diameter A1 of the second piston 11. In the embodiment shown, in which upon relief of the high-pressure region 17 the valve closing member 12 is kept in the closing position against the first valve seat 14 by a spring force F_F of a spring 31 that is disposed between the valve closing member 12 and the second valve seat 15, the spring force F_F is still another parameter for the geometric definition of the throttle body 26 and of the first piston 9.

The system pressure p_sys is adjusted such that it is always less than a maximum allowable system pressure, which in turn is equivalent to a pressure level at which an automatic valve opening ensues without actuation of the actuator unit 4.

Figure 2:
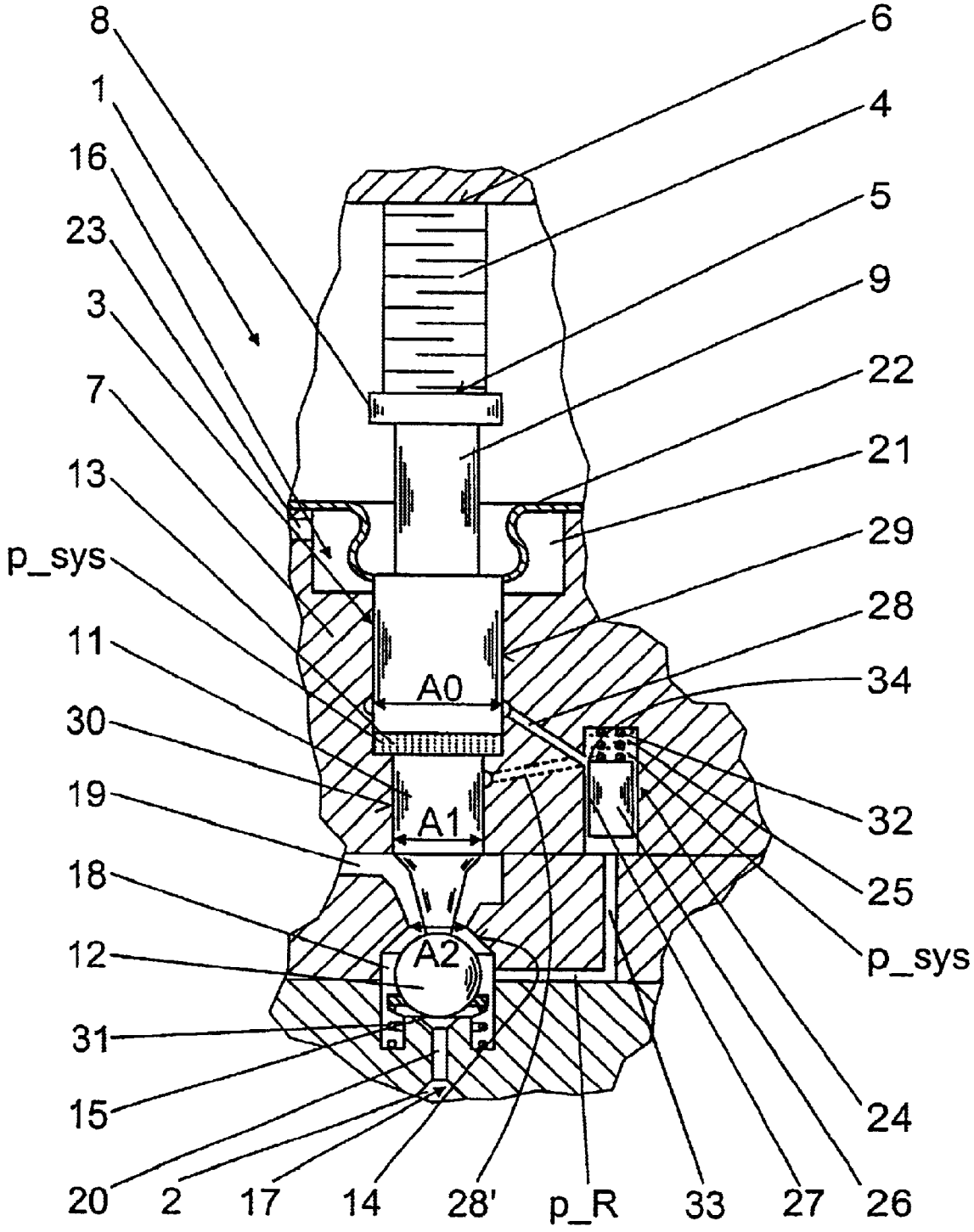
FIG. 2, a schematic, fragmentary view of a further exemplary embodiment of the invention in longitudinal section, in which a throttle body of a filling device is supported axially displaceably.

In FIG. 2, a variant embodiment of the exemplary embodiment shown in FIG. 1 is shown, in which for the sake of simplicity, functionally identical components are identified by the same reference numerals used in FIG. 1.

Compared to the version of FIG. 1, in which the throttle body 26 is disposed essentially axially immovably in the hollow chamber 25 of the filling device 24, here the throttle body 26 is disposed axially displaceably in the hollow chamber 25 by means of a spring device 32. In the hollow chamber 25, the throttle body 26 is displaced against a stop 33 on the high-pressure side by the spring force of the spring device 32 upon relief of the high-pressure region 17. When high pressure p_R is applied, the throttle body 26 is displaced counter to the spring force of the spring device 32 and to the system pressure. The spring force and the dimensioning of the throttle body 26 are designed such that the throttle body 26, with its end toward the system pressure that forms a control edge 34, at least partly intersects the branching point of the system pressure line 28 if the system pressure p_sys drops impermissibly. The spring device 32 thus makes an automatic correction of the system pressure p_sys possible, as a function of the leakage via the pistons 9 and 11 resulting from temperature and positional factors. Specifically, as soon as the system pressure p_sys drops, the overlap of the control edge 34 and the branching point of the system pressure line 28 shortens the effective sealing length or leakage gap length along the throttle body 26, and the leaks are compensated for. In this way, the system pressure p_sys can be kept constant in the hydraulic chamber.

Along with the function of the spring device 32 of forming a self-regulating system with the throttle body 26 that can react to pressure changes, that is, pressure losses in the system pressure region, the axial mobility of the throttle body 26 advantageously also assures that the gap 27 is automatically cleaned and does not become plugged with dirt particles contained in the fuel.

In both embodiments shown, the line 33 of the filling device 24 that branches off from the high-pressure region 17 communicates with the valve chamber 18, in which the valve closing member 12 is movable between the valve seats 14 and 15, and which can also be integrated with a high-pressure line.

In a departure from this, it is understood that it can also be provided that the line 33 leading away from the high-pressure region 17 can communicate with a high-pressure inlet from a high-pressure pump to the valve control chamber 2 or with other regions in the high-pressure region 17, such as the valve control chamber or the outlet throttle 20.

The fuel injection valve 1 of FIG. 1 or FIG. 2 functions as follows.

When there is no current to the piezoelectric actuator 4, that is, in the closed state of the fuel injection valve 1, the valve closing member 12 is pressed against the upper valve seat 14 assigned to it by the high pressure or rail pressure p_R and the spring 31.

Upon slow actuation, for instance because of temperature-caused changes in length of the piezoelectric actuator 4 or other valve components, the first piston 9 upon an increase in temperature forces its way into the hydraulic chamber 13 and is retracted from it again upon a temperature drop, without this having any overall effects on the closing and opening position of the valve closing member 12 and of the fuel injection valve 1.

To open the valve and thus for injection through the fuel injection valve 1, the piezoelectric actuator 4 is acted upon by voltage, so that it suddenly expands axially. In the process, the piezoelectric actuator 4 is braced against the valve body 7 and builds up an opening pressure in the hydraulic chamber 13. When the valve 1 is in equilibrium because of the system pressure p_sys in the hydraulic chamber 13, the second piston 11 of the valve closing member 12 moves out of its upper valve seat 14 into a middle position between the two valve seats 14, 15. At a high rail pressure p_R, a greater force is necessary to attain the equilibrium pressure on the side of the piezoelectric actuator. This greater force is brought to bear by the filling device 24, in that at a high rail pressure p_R, the pressure p_sys in the hydraulic chamber 13 is increased accordingly as well. In this way, the piezoelectric force on the valve closing member 12 is increased, for the same voltage on the piezoelectric actuator 4; the increase in pressure is due to the system pressure p_sys and the diameter Al of the second piston 11. This pressure increase is equivalent to a substantially higher voltage that would have to be applied to the piezoelectric actuator, and thus the force reserve gained can be utilized for instance to make the piezoelectric actuator smaller.

As soon as the valve closing member 12 has reached its lower valve seat 15 counter to the rail pressure p_R, the voltage to the piezoelectric actuator 4 is disrupted, whereupon the valve closing member 12 returns to its middle position, and another fuel injection takes place. At the same time, refilling of the hydraulic chamber 13 to the system pressure p_sys takes place via the filling device 23.

The embodiments described each pertain to a so-called double-seat valve, but it is understood that the invention can also be applied to single-switching valves with only a single valve seat.

The foregoing relates to preferred exemplary embodiment of the invention, it being understood that other variants and embodiments thereof are possible within the spirit and scope of the invention, the latter being defined by the appended claims.

What is claimed is:

1. A valve for controlling fluids, comprising an actuator unit (4), in particular a piezoelectric unit, for actuating a valve member (3), which is axially displaceable in a valve body and with which a valve closing member (12) is associated, which valve closing member cooperates with at least one valve seat (14, 15) for opening and closing the valve (1) and separates a low-pressure region (16) at system pressure from a high-pressure region (17), the valve member (3) having at least one first piston (9) and one second piston (11) between which a hydraulic chamber (13) functioning as a hydraulic booster is embodied, and a filling device (24) connectable to the high-pressure region (17) to compensate for leakage losses, the filling device (24) being embodied with at least one channel-like hollow chamber (25), in which at least one throttle body (26) is disposed in such a way that on one end of the throttle body (26), a line (33) leading to the high-pressure region (17) discharges into the hollow chamber, and that on the opposite end of the throttle body (26), a system pressure line (28) leading to the hydraulic chamber (13) branches off, and by geometric definition of the throttle body (26), embodied as a solid body, of a gap (27) surrounding it, and of the dimensions of the piston (9) along which the system pressure (p_sys) is reduced toward the low-pressure region (16), a system pressure (p_sys) builds up in the high-pressure region (17) as a function of a prevailing pressure (p_R).

2. The valve of one of claim 1, wherein the geometric definition of the throttle body (26) and/or of the piston (9) along which the system pressure (p_sys) is reduced toward the low-pressure region (16) is selected as a function of at least the parameters of the seat diameter (A2) and the ratio of the diameter (A0) of the first piston (9) to the diameter (A1) of the second piston (11).

3. The valve of claim 1, further comprising a spring (31) having a spring force (F_F), the spring (31) being disposed between the valve closing member (12) and a second valve seat (51) toward the high-pressure region (17) and keeps the valve closing member (12) in the closing position on the first valve seat (14) upon relief of the high-pressure region (17), is one parameter for the geometric definition of the at least one throttle body (26) and of the piston (9) along which the system pressure (p_sys) is reduced toward the low-pressure region (16).

4. The valve of claim 1, wherein the geometric definition is effected such that the system pressure (p_sys) in the hydraulic chamber (13) is always less than a maximum allowable system pressure, and the maximum allowable system pressure of the hydraulic chamber (13) is preferably equivalent to a pressure at which an automatic valve opening ensues without actuation of the actuator unit (4).

5. The valve of claim 1, wherein the at least one throttle body (26) is embodied as a cylindrical pin, and the diameter, referred to the respective surrounding bore (27, 28), and the length of the throttle body (26) and of the piston (3) along which the system pressure (p_sys) is reduced to the low-pressure region (16), are varied upon the geometric definition thereof.

6. The valve of claim 1, wherein the system pressure line (28) leading to the hydraulic chamber (13) leads into the hydraulic chamber via a gap (29) adjoining the hydraulic chamber (13) and surrounding the first piston (9) and/or a gap (30) surrounding the second piston (11), preferably via the gap (29) surrounding the first piston (9).

7. The valve of claim 1, wherein the actuator unit is embodied as a piezoelectric unit (4).

8. The valve of claim 1, wherein the at least one throttle body (26) is disposed axially adjustably in the hollow chamber (25).

9. The valve of one of claim 8, wherein the geometric definition of the throttle body (26) and/or of the piston (9) along which the system pressure (p_sys) is reduced toward the low-pressure region (16) is selected as a function of at least the parameters of the seat diameter (A2) and the ratio of the diameter (A0) of the first piston (9) to the diameter (A1) of the second piston (11).

10. The valve of claim 8, further comprising a spring (31) having a spring force (F_F), the spring (31) being disposed between the valve closing member (12) and a second valve seat (51) toward the high-pressure region (17) and keeps the valve closing member (12) in the closing position on the first valve seat (14) upon relief of the high-pressure region (17), is one parameter for the geometric definition of the at least one throttle body (26) and of the piston (9) along which the system pressure (p_sys) is reduced toward the low-pressure region (16).

11. The valve of claim 8, wherein the geometric definition is effected such that the system pressure (p_sys) in the hydraulic chamber (13) is always less than a maximum allowable system pressure, and the maximum allowable system pressure of the hydraulic chamber (13) is preferably equivalent to a pressure at which an automatic valve opening ensues without actuation of the actuator unit (4).

12. The valve of claim 8, wherein the at least one throttle body (26) is embodied as a cylindrical pin, and the diameter, referred to the respective surrounding bore (27, 28), and the length of the throttle body (26) and of the piston (3) along which the system pressure (p_sys) is reduced to the low-pressure region (16), are varied upon the geometric definition thereof.

13. The valve of claim 8, wherein the system pressure line (28) leading to the hydraulic chamber (13) leads into the hydraulic chamber via a gap (29) adjoining the hydraulic chamber (13) and surrounding the first piston (9) and/or a gap (30) surrounding the second piston (11), preferably via the gap (29) surrounding the first piston (9).

14. The valve of claim 8, wherein the throttle body (26) is disposed axially movably in the hollow chamber (25) in such a way that the throttle body (26) at least partly intersects the branching point of the system pressure line (28) when the system pressure (p_sys) drops.

15. The valve of one of claim 14, wherein the geometric definition of the throttle body (26) and/or of the piston (9) along which the system pressure (p_sys) is reduced toward the low-pressure region (16) is selected as a function of at least the parameters of the seat diameter (A2) and the ratio of the diameter (A0) of the first piston (9) to the diameter (A1) of the second piston (11).

16. The valve of claim 14, wherein the throttle body (26), for automatic correction of the system pressure (p_sys) in the hollow chamber (25), is axially displaceable by means of a spring device (32) disposed on the side of the throttle body toward the system pressure line (28).

17. The valve of claim 8, wherein the throttle body (26), for automatic correction of the system pressure (p_sys) in the hollow chamber (25), is axially displaceable by means of a spring device (32) disposed on the side of the throttle body toward the system pressure line (28).

18. The valve of one of claim 17, wherein the geometric definition of the throttle body (26) and/or of the piston (9) along which the system pressure (p_sys) is reduced toward the low-pressure region (16) is selected as a function of at least the parameters of the seat diameter (A2) and the ratio of the diameter (A0) of the first piston (9) to the diameter (A1) of the second piston (11).

19. The valve of claim 17, further comprising a spring (31) having a spring force (F_F), the spring (31) being disposed between the valve closing member (12) and a second valve seat (51) toward the high-pressure region (17) and keeps the valve closing member (12) in the closing position on the first valve seat (14) upon relief of the high-pressure region (17), is one parameter for the geometric definition of the at least one throttle body (26) and of the piston (9) along which the system pressure (p_sys) is reduced toward the low-pressure region (16).

20. The valve of claim 17, wherein the system pressure line (28) leading to the hydraulic chamber (13) leads into the hydraulic chamber via a gap (29) adjoining the hydraulic chamber (13) and surrounding the first piston (9) and/or a gap (30) surrounding the second piston (11), preferably via the gap (29) surrounding the first piston (9).

* * * * *

UNITED STATES PATENT AND TRADEMARK OFFICE

CERTIFICATE OF CORRECTION

PATENT NO. : 6,719,264 B2
DATED : April 13, 2004
INVENTOR(S) : Patrick Mattes

It is certified that error appears in the above-identified patent and that said Letters Patent is hereby corrected as shown below:

Title page,
Insert Item:

-- [74] *Attorney, Agent, or Firm* --- Ronald E. Greigg --

Signed and Sealed this

Eighth Day of June, 2004

JON W. DUDAS
*Acting Director of the United States Patent and Trademark Office*